United States Patent [19]

Gut et al.

[11] Patent Number: 4,897,242

[45] Date of Patent: Jan. 30, 1990

[54] PROCESS FOR TREATING MOLTEN CAST IRON IN AN OPEN LADLE BY MEANS OF PURE MAGNESIUM

[75] Inventors: Karl Gut, Benken; Ivo Henych, Stetten, both of Switzerland

[73] Assignee: Georg Fischer AG, Schaffhausen, Switzerland

[21] Appl. No.: 349,642

[22] Filed: May 10, 1989

[30] Foreign Application Priority Data

May 10, 1988 [CH] Switzerland ..... 01773/88

[51] Int. Cl.[4] ..... C21C 7/02

[52] U.S. Cl. ..... 420/23; 75/53; 75/58

[58] Field of Search ..... 75/53, 58; 420/23

[56] References Cited

U.S. PATENT DOCUMENTS 3,957,502 5/1976 Cull ..... 75/58

4,040,818 8/1977 Clegg ..... 75/58

4,364,771 12/1982 Cordier ..... 75/58

4,541,867 9/1985 Neelameggham ..... 75/58

4,592,777 6/1986 Rellermeyer ..... 75/58

*Primary Examiner*—Peter D. Rosenberg

*Attorney, Agent, or Firm*—Bachman & LaPointe

[57] ABSTRACT

A process for treating molten cast iron in an open ladle by means of pure magnesium is proposed, wherein the pure magnesium is introduced in a multiplicity of very small magnesium particles, coated with a protective layer, into the molten cast iron.

The protective layer, which protects the magnesium from premature melting and controls the reaction rate, is produced from ceramics.

The process can be carried out with very simple equipment. Involved pretreatments of the treatment agent are unnecessary.

2 Claims, No Drawings

PROCESS FOR TREATING MOLTEN CAST IRON IN AN OPEN LADLE BY MEANS OF PURE MAGNESIUM

The invention relates to a process for treating molten cast iron in an open ladle by means of pure magnesium for the production of cast iron with ferrodal or vermicular graphite.

Because of the low density (1.74 g/cm$^3$), the low melting point (650° C.) and the low vaporization temperature (1102° C.) of magnesium, direct addition to high-melting metals, such as cast iron, without special equipment such as a converter, bell, injection lance and the like, is impossible. At a normal treatment temperature of 1500° C., the vapor pressure reaches about 10 bar and the reaction proceeds explosively.

For controlling the reaction, prealloys with FeSi, Ni and the like are used, the Mg concentration reaching only 3 to 30% and the reaction rate being reduced thereby.

The existing processes for treating molten cast iron in a simple open ladle by means of pure magnesium utilize the damping effect of ceramic coating of the blocks of pure magnesium, a small part of the surface remaining bright, i.e. not being covered by ceramic material. In this way, the contact area between pure magnesium and the melt to be treated, and also the reaction rate, are reduced. Mg blocks pretreated in this way are then introduced into the melt by means of a bell.

In another known treatment method, the dissolution rate of a magnesium block is controlled by means of a ceramic coating of uneven thickness.

According to another process, pulverulent Mg is agglomerated together with iron powder. As a result, the magnesium activity is lower.

All these measures result from the fact that the addition of pure magnesium having a melting point of 650° C. and a vaporizing temperature of 1102° C. to molten cast iron of a temperature of, for example, 1500° C. is impossible. At this temperature, the magnesium evolves a vapor pressure of about 10 bar, and such a reaction would proceed explosively.

The disadvantage of the above-mentioned process is, on the one hand, that the magnesium, at the usual temperatures and the relatively low pressure of the molten cast iron present in an open ladle, mixes in the liquid form to a very small extent with the melt, and that the Mg predominantly rises as vapor through the melt. The reaction is then less effective, which leads to poor output.

On the other hand, these known processes require more or less complicated equipment for carrying them out and/or involved pretreatments of the treatment agent.

It is the object of the present invention to eliminate the said disadvantages in known processes.

The basic idea of the process according to this invention is to distribute the magnesium in a multiplicity of very small particles provided with protective layer, for example as granules, over a large volume of the molten cast iron and to cause it to react with the latter. The reaction time is here adjusted such that the magnesium particles react with the melt before they reach the surface of the molten cast iron. The rate of rise is determined by Stock's law. According to Stock's law, the rate of rise of the particles in the melt is described as follows:

$$V = \frac{2\,g\,a^2\,(\gamma s - \gamma t)}{9\,\eta}$$

g=acceleration due to gravity
a=radius of the particle
$\gamma_s$=density of the melt
$\gamma_t$=density of the particles
$\eta$=absolute viscosity of the melt This equation permits the size of the particles to be fixed in such a way that these rise in the melt at only such a rate that they are completely molten and dissolved in the melt during the rise time.

The size of the particle is dependent on the bath depth of the melt, that is to say on the time available for melting.

As a rule, commercially available Mg granules are used, sorted according to size. It would also be possible to alloy the molten metal in the same way with further highly reactive metals such as Ca, Sr, Ba, Li and the like.

The result of this is that, around the individual magnesium particles, there is sufficient melt which effects adequate dilution of the molten magnesium by absorbing the latter, and that vaporization of the magnesium is prevented at the same time. This can be achieved, for example, by adding the magnesium provided with the protective layer under control at a defined rate to the molten iron, while the ladle is being filled with the latter, or that the coated granules of magnesium are released with application of the known sandwich process, for example layerwise. Owing to the widely varying size of the granule particles and to the different rate of rise, the granule particles will react at a different height, that is to say in a relative large volume region of the melt. The protective layer which protects the magnesium and the above-mentioned metals from premature melting, is advantageously produced from ceramics based on $SiO_2$, $Cr_2O_3$, SiC, $ZrO_2$, $Al_2O_3$, CaO, graphite, CaSi, metallic powders and the like. The binders used can be any conventional binders such as aluminum phosphate, water glass, bentonite, synthetic resin and the like.

The individual coated particles rise through the melt and, when they reach the critical temperature which, for example, is about 700° C. for Mg, burst the coating and dissolve in the melt. Since only a limited amount of oxygen is available, the oxidation is minimized. Owing to the latent heat of fusion of the treatment agent, the temperature in the surroundings is lowered, and the treatment agents dissolve in the melt with minimum vaporization.

The deposition of the reaction products from the melt can be accelerated by introducing inert gas or by centrifuging the treated melt in the treatment ladle.

We claim:

1. A process for treating molten iron in an open ladle with magnesium comprising providing a volume of molten iron in an open ladle, providing a plurality of desired sized coated particles of metal selected from the group consisting of magnesium and magnesium alloys wherein the coating is a protective coating consisting of (1) a ceramic material selected from the group consisting of $SiO_2$, $Cr_3O_3$, SiC, $ZrO_2$, $Al_2O_3$, CaO, CaSi and mixtures thereof and (2) binders, introducing said plurality of coated particles into said volume of molten metal below the surface thereof wherein the size of said particles is selected such that the rise of said particles through the molten iron takes longer than the reaction time of said particles with the molten iron thereby insuring adequate dilution of the magnesium by the molten iron.

2. A process according to claim 1 wherein said particles are bonded together as a whole in such a way that they individually fuse and go into solution.

* * * * *